US011999536B2

(12) United States Patent
Zhou et al.

(10) Patent No.: US 11,999,536 B2
(45) Date of Patent: Jun. 4, 2024

(54) COVER AND WATER CONTAINER USING SAME

(71) Applicant: Ningbo Lisi Houseware Co., Ltd., Ningbo (CN)

(72) Inventors: Yongning Zhou, Ningbo (CN); Lu Wang, Ningbo (CN); Suwei Zheng, Ningbo (CN); Yaxue Jin, Ningbo (CN)

(73) Assignee: Ningbo Lisi Houseware Co., Ltd., Ningbo (CN)

( * ) Notice: Subject to any disclaimer, the term of this patent is extended or adjusted under 35 U.S.C. 154(b) by 0 days.

(21) Appl. No.: 17/980,330

(22) Filed: Nov. 3, 2022

(65) Prior Publication Data

US 2023/0137802 A1 May 4, 2023

Related U.S. Application Data

(63) Continuation of application No. PCT/CN2021/141109, filed on Dec. 24, 2021.

(30) Foreign Application Priority Data

Nov. 4, 2021 (CN) ..... 202122688316.2

(51) Int. Cl.
*B65D 47/08* (2006.01)

(52) U.S. Cl.
CPC .... *B65D 47/0885* (2013.01); *B65D 2251/105* (2013.01); *B65D 2251/1066* (2013.01)

(58) Field of Classification Search
CPC .... B65D 2251/1016; B65D 2251/1058; B65D 47/04–0885; B65D 2251/10–105; B65D 2251/1066; B65D 2251/1075
See application file for complete search history.

(56) References Cited

U.S. PATENT DOCUMENTS 5,147,054 A * 9/1992 Pehr ..... B65D 51/20 215/253
5,356,017 A * 10/1994 Rohr ..... B65D 50/045 215/245

(Continued)

FOREIGN PATENT DOCUMENTS

CN 203417049 U 2/2014
CN 203576196 U 5/2014

(Continued)

OTHER PUBLICATIONS

Patent Cooperation Treaty, "International Search Report" issued in connection with International Application No. PCT/CN2021/141109, dated Aug. 8, 2022, 7 pages.

(Continued)

*Primary Examiner* — Kareen K Thomas
(74) *Attorney, Agent, or Firm* — Hanley, Flight & Zimmerman, LLC

(57) ABSTRACT

This disclosure relates to a cover and a water container using the cover. The cover comprises a cover base, an upper cover, a bracket, a pressing ring and a button. The upper cover is hinged to the cover base and has a first snap portion. The pressing ring is hinged to the bracket and has a snap-fit portion for snapping the upper cover. The button is pivotally arranged on the cover base in a lever manner and has an upper end and a lower end. The upper end of the button has a second snap portion. The pressing ring is connected to the cover base by a reset elastic member. When the pressing ring is turned relative to the bracket and pushes against the lower end of the button, a pushing force is applied to the lower end of the button to disengage the second snap portion from the first snap portion. The user operates the overturn of the pressing ring with one hand to disengage the pressing ring from the upper cover and disengage the button from the upper cover, and then the cover is completely opened. After (Continued)

the pressing ring and the button return to their original positions, the user can turn the upper cover with one hand again, and then the cover can be easily closed. In this way, users can open and close the cover with one hand conveniently.

9 Claims, 8 Drawing Sheets

(56) References Cited

U.S. PATENT DOCUMENTS

2004/0217139 A1* 11/2004 Roth ..... B65D 47/0842 215/237
2005/0205607 A1* 9/2005 Hierzer ..... B65D 47/0804 222/546
2007/0251909 A1* 11/2007 Decelles ..... B65D 47/0828 215/221
2010/0170910 A1* 7/2010 Ludewigs ..... B65D 47/0838 215/254
2014/0117016 A1 5/2014 Hodge
2014/0224802 A1* 8/2014 Gonnert ..... B29C 45/0017 220/265
2014/0299599 A1 10/2014 Hodge
2014/0305941 A1 10/2014 Hodge
2014/0319138 A1 10/2014 Polt
2014/0339247 A1* 11/2014 Gonnert ..... B65D 47/36 220/829
2015/0282654 A1 10/2015 Kurabe et al.
2016/0130045 A1* 5/2016 Giraud ..... A61J 1/03 220/315
2016/0229597 A1 8/2016 Polt

FOREIGN PATENT DOCUMENTS

CN 203969967 U 12/2014
CN 104921549 A 9/2015
CN 104973324 A 10/2015
CN 205053621 U 3/2016
CN 205107161 U 3/2016
CN 205107162 U 3/2016
CN 105996666 A 10/2016
CN 107581855 A 1/2018
CN 207912509 U 9/2018
CN 210748562 U 6/2020
CN 211408480 U 9/2020
CN 212489448 U 2/2021
CN 213097338 U 5/2021
CN 213587982 U 7/2021
CN 213882734 U 8/2021
CN 216256550 U 4/2022
CN 216724040 U 6/2022
CN 217338130 U 9/2022
CN 217565583 U 10/2022

OTHER PUBLICATIONS

Patent Cooperation Treaty, "Written Opinion of the International Searching Authority" issued in connection with International Application No. PCT/CN2021/141109, dated Aug. 3, 2022, 8 pages.

* cited by examiner

COVER AND WATER CONTAINER USING SAME

RELATED APPLICATIONS

This patent is a continuation of International Patent Application Serial No. PCT/CN2021/141109, having an international filing date of Dec. 24, 2021, and claims benefit of Chinese Patent Application No. 202122688316.2, filed on Nov. 4, 2021, which are hereby incorporated by reference in their entireties for all purposes.

BACKGROUND OF THE INVENTION

1. Technical Field

This disclosure relates to the field of water containers, in particular to a cover and a water container using the same.

2. Description of Related Art

In daily life, water containers such as drinking cups and thermos cups have become commonly used products in people's lives. The water container includes a cover and a container body for containing water or beverages. Users can drink water or other beverages in the water container at any time according to their needs when they are at home, at work, or when they go out.

However, these current water containers have some problems: the cover of the water container and the container body are mostly fastened together by means of threads. Once the user wants to drink water, the user has to hold the container body with one hand and unscrew the cover with the other hand, and then the user opens the cover to drink the water in the container body. After drinking the water, the user also has to screw the cover onto the container body with the cooperation of two hands.

BRIEF SUMMARY OF THE INVENTION

In view of the prior art, a first technical problem to be solved by this disclosure is to provide a cover capable of being opened or closed by users with one hand.

A second technical problem to be solved by this disclosure is to provide a water container using the cover.

A technical solution adopted in this disclosure to solve the first technical problem is: a cover, comprising:

- a cover base;
- an upper cover hinged to the cover base, the upper cover having a first snap portion;
- a bracket located on the cover base;
- a pressing ring hinged to the bracket, the pressing ring having a snap-fit portion for snapping the upper cover; and
- a button pivotally arranged on the cover base in a lever manner, the button having an upper end and a lower end, the upper end of the button having a second snap portion in snap fit with the first snap portion of the upper cover;
- wherein the pressing ring is connected to the cover base by a reset elastic member, and when the pressing ring is turned relative to the bracket and pushes against the lower end of the button, a pushing force is applied to the lower end of the button to disengage the second snap portion from the first snap portion.

As an improved implementation, in the cover, one end of the reset elastic member is connected to the bracket directly or indirectly, and the other end of the reset elastic member is connected to the pressing ring.

As an implementation of the reset elastic member, further improvedly, in the cover, the reset elastic member is configured as a torsion spring.

Further, the cover also comprises a pivot shaft passing through the bracket, and the pivot shaft passes through two opposite sides of the pressing ring, and the torsion spring is fitted over the pivot shaft.

As another implementation of the reset elastic member, further improvedly, in the cover, the reset elastic member is configured as an elastic material component. For example, the elastic material component here may be an elastic rubber component, such as a rubber ring.

As an arrangement mode of the above-mentioned snap-fit portion, improvedly, in the cover, the snap-fit portion is located at the upper end of the pressing ring.

Further improvedly, in the cover, the first snap portion comprises:

- a first step matched with the snap-fit portion of the pressing ring to achieve a snap fit; and
- a second step, located under the first step and snap-fitted with the second snap portion of the button.

In order to make the upper cover achieve snap fit with the pressing ring and the button more smoothly, and further improvedly, in the cover, a first guide surface is arranged at a position where the first snap portion of the upper cover is in snap fit with the pressing ring, and/or a second guide surface is arranged at a position where the first snap portion of the upper cover is in snap fit with the button.

A technical solution adopted by this disclosure to solve the second technical problem is: a water container, comprising a container body using the cover described in any one of the above.

Compared with the prior art, this disclosure has the following advantages:

Firstly, according to this disclosure, based on the existing cover structure with a pressing ring, a snap fit structure between the cover and the pressing ring and a snap fit structure between the cover and the button are added and the button is arranged on the bracket of the cover in a lever manner, so that the button can be disengaged from the cover under the pushing force of the overturned pressing ring. In this way, the user can easily operate the overturn of the pressing ring with one hand to disengage the pressing ring from the upper cover and disengage the button from the upper cover, and then the cover is completely opened. After the pressing ring and the button return to their original positions, the user can turn the upper cover with one hand again, and then the cover can be easily closed. In this way, users can open and close the cover with one hand conveniently.

Secondly, since corresponding guide surfaces are respectively arranged at the position where the first snap portion of the upper cover is in snap fit with the pressing ring and the position where the first snap portion of the upper cover is in snap fit with the button, the upper cover can be snap-fitted with the pressing ring and the button respectively more smoothly.

DETAILED DESCRIPTION OF THE INVENTION

Figure 1:
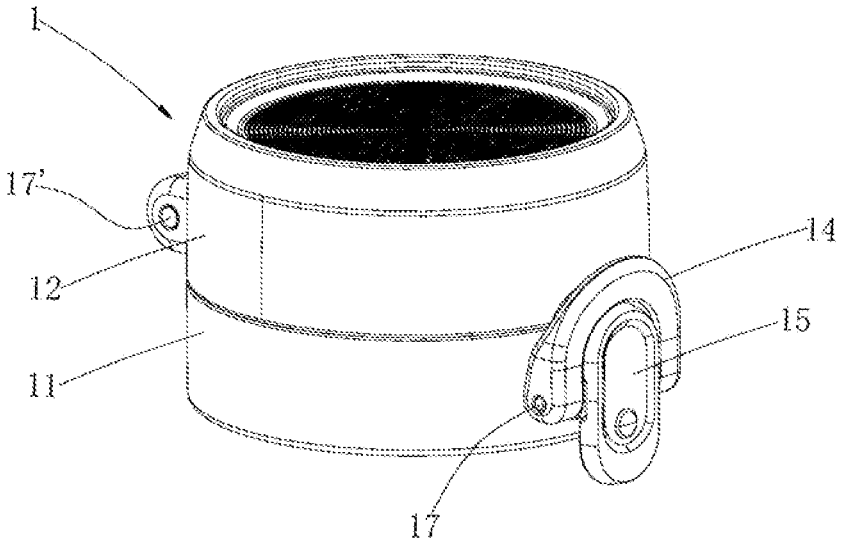
FIG. 1 is a schematic structural diagram of a cover according to Embodiment 1 of this disclosure.
Figure 2:
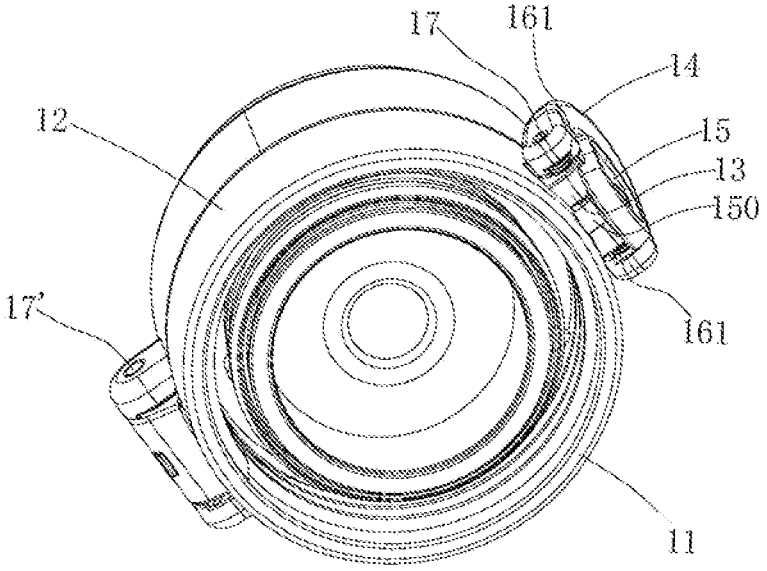
FIG. 2 is a schematic diagram of the cover shown in FIG. 1 in another perspective.

This disclosure is described below in further detail with reference to accompanying drawings and an embodiment.

Embodiment 1

This embodiment provides a cover, in particular, it can be used in cooperation with a water container body such as a cup. Referring to FIGS. 1 to 5, the cover of this embodiment comprises a cover base 11, an upper cover 12, a bracket 13, a pressing ring 14 and a button 15.

The cover base 11 has a first shaft hole 110 and a water outlet 111. The upper cover 12 has a first snap portion 121 and a water blocking member 12 for blocking the water outlet 111. The end of the upper cover 12 has a pair of second shaft holes 120 corresponding to each other, and the second shaft holes 120 and the first shaft hole 110 of the cover base 11 are arranged corresponding to each other. The upper cover 12 is hinged to the cover base 11. Specifically, the hinged connection between the upper cover 12 and the cover base 11 is achieved through a pivot shaft 17' with a torsion spring 161' fitted over the outside passing through the first shaft hole 110 and the second shaft holes 120.

The bracket 13 is located on the cover base 11 and provided with a set of first rotating shaft holes 130 arranged opposite to each other. The pressing ring 14 has two second rotating shaft holes 140 and a snap-fit portion 141 for snapping the upper cover 12, the snap-fit portion 141 is located at the upper end of the pressing ring 14, the two second shaft holes 140 are located on two opposite sides of the pressing ring 14, and the pressing ring 14 is hinged to the bracket 13 through a pivot shaft 17 passing through the second pivot hole 140 and the first pivot hole 130; a torsion spring 161 serving as a reset elastic member is fitted over the outer side of the pivot shaft 17, one end of the torsion spring 161 is connected to the pressing ring 14, and the other end of the torsion spring 161 is connected to the bracket 13 directly or indirectly.

The button 15 has an upper end 151, a lower end 152 and a fulcrum (not shown in the figures) between the upper end 151 and the lower end 152. The upper end 151 of the button 15 has a second snap portion 153 that is snap-fitted with the first snap portion 121 of the upper cover 12, and an elastic contact member 150 is formed on the lower end 152. The elastic contact member 150 can be made of an elastic silicone material; wherein the button 15 is arranged on the cover base 11 in a lever manner through the cooperation between the fulcrum and the cover base 11.

When the pressing ring 14 is turned relative to the bracket 13 and pushes against the lower end 152 of the button 15, a pushing force is applied to the lower end 152 of the button 15 to disengage the second snap portion 153 from the first snap portion 121.

Figure 6:
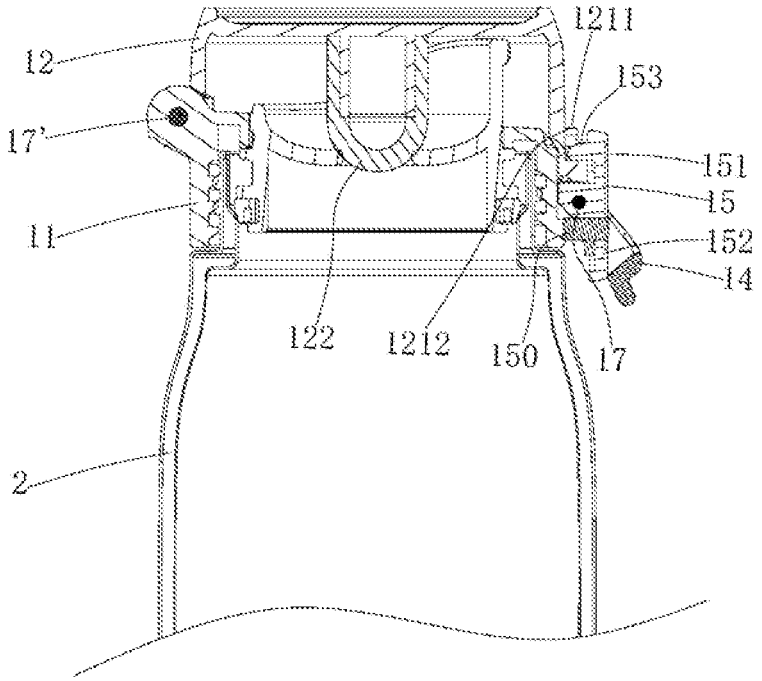
FIG. 6 is a schematic diagram of the cover shown in FIG. 1 when the pressing ring is disengaged from the upper cover.
Figure 7:
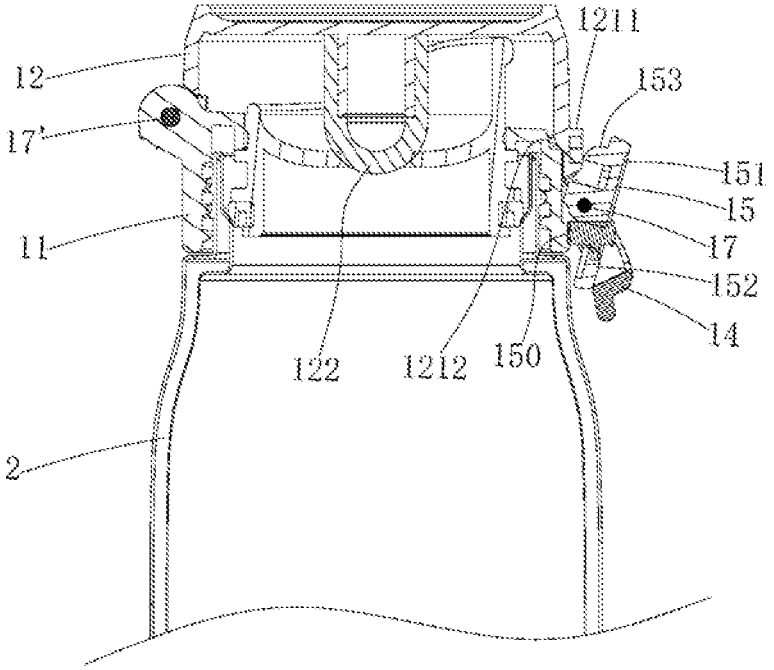
FIG. 7 is a schematic diagram of the cover shown in FIG. 1 when the button is initially opened.
Figure 8:
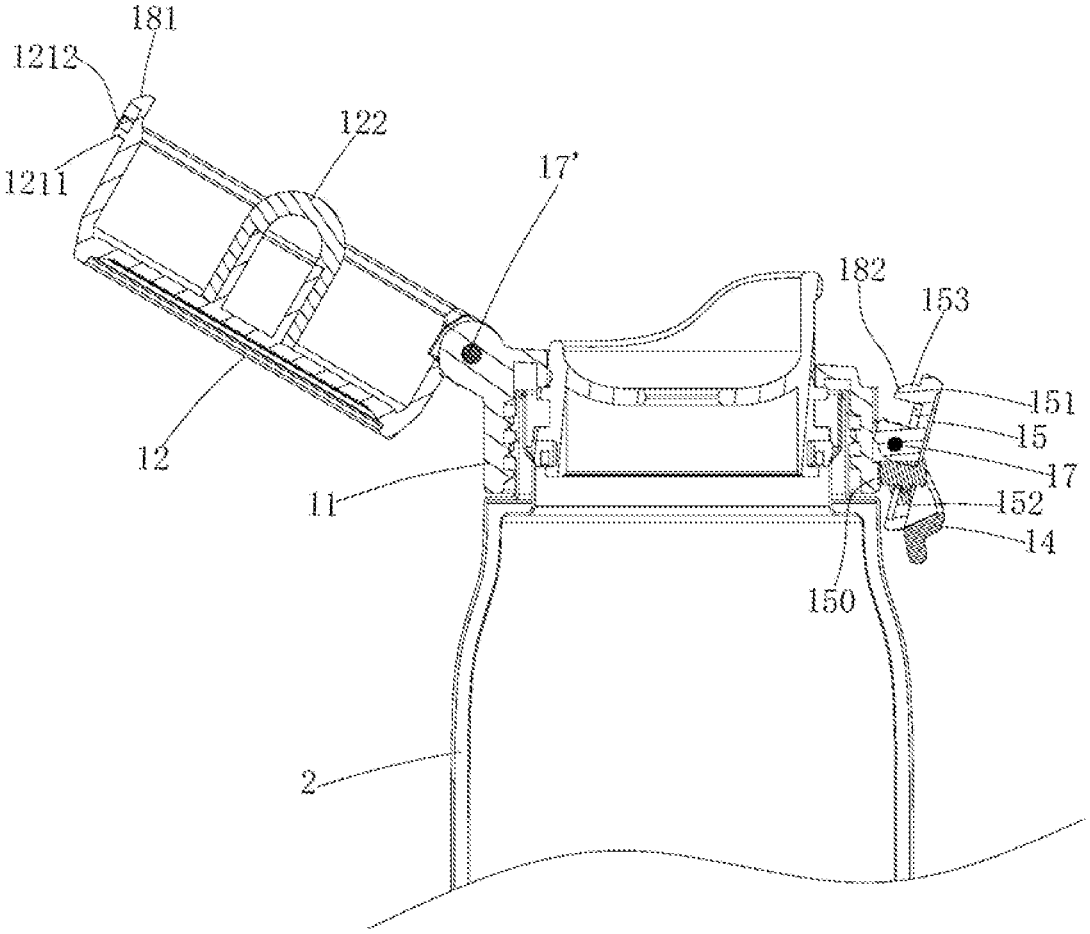
FIG. 8 is a schematic diagram of the cover shown in FIG. 1 when the upper cover is opened.
Figure 9:
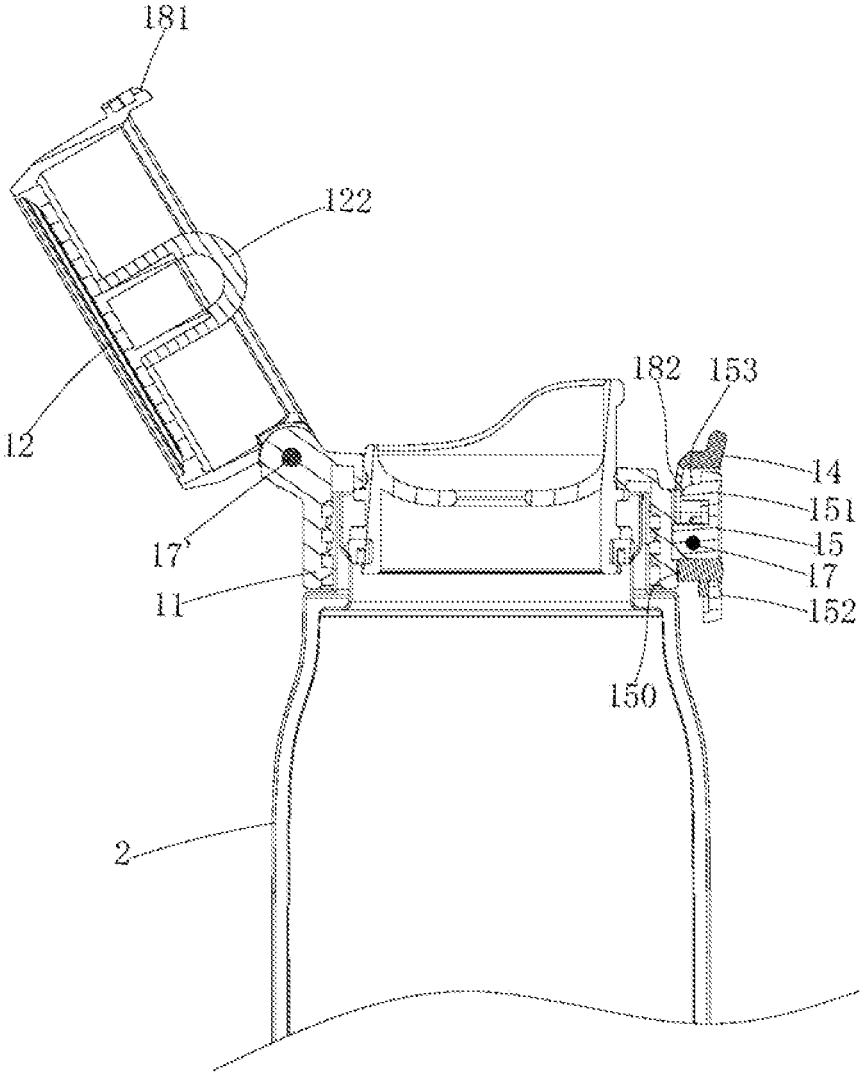
FIG. 9 is a schematic diagram of the cover shown in FIG. 1 after the pressing ring and the button return to their original positions.
Figure 10:
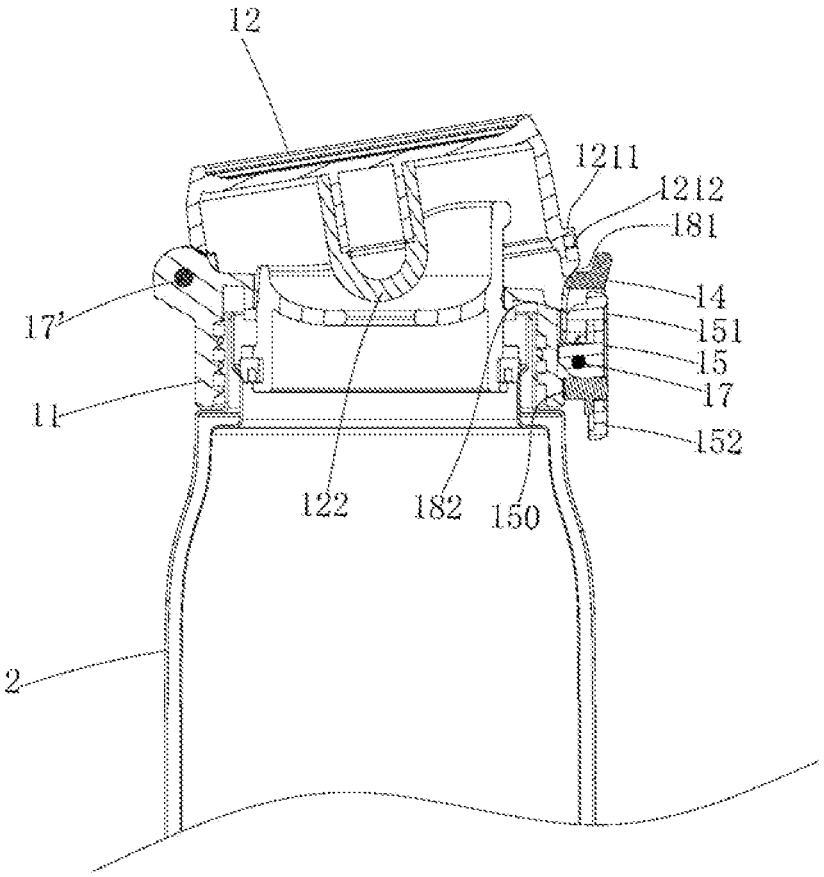
FIG. 10 is a schematic diagram of the cover shown in FIG. 1 when the upper cover is initially closed.

That is to say, the user can turn the pressing ring 14 with one hand, and the snap-fit portion 141 of the pressing ring 14 is disengaged from the upper cover 12 first, and then continues to turn the pressing ring 14 so that the pressing ring 14 pushes against the lower end 152 of the button 15. The torsion spring 161 will be compressed and deformed due to the movement of the pressing ring 14. Since the button 15 is arranged on the cover base 11 in a lever manner, the elastic contact member 150 on the lower end 152 will push against the cover base 11, and the elastic contact member 150 is also compressed and deformed. Due to the existence of the above-mentioned fulcrum, the upper end 151 of the button 15 moves in a direction opposite to the lower end 152 (i.e., away from the cover base 11), so that the second snap portion 153 of the upper end 151 is disengaged from the first snap portion 121 of the upper cover 12, and then the entire upper cover 12 is completely opened. FIGS. 6, 7 and 8 respectively show the case where the upper cover is disengaged from the pressing ring, the case where the button is disengaged from the upper cover, and the case where the upper cover is fully opened. Since both the torsion spring 161 and the elastic contact member 150 have been compressed and deformed, after the overturning force applied to the pressing ring 14 is removed, the torsion spring 161 will be reset under the action of the elastic resilience, and the elastic contact member 150 will also produce a reset movement until the upper end of the pressing ring 14 and the button 15 return to their original positions again, as shown in FIG. 9 for details. Certainly, the user can perform a reverse operation on the cover with the upper cover opened with one hand, and then the upper cover 12 can close the cover base 11, thus finishing the single-handed cover closing operation for the cover.

Figure 3:
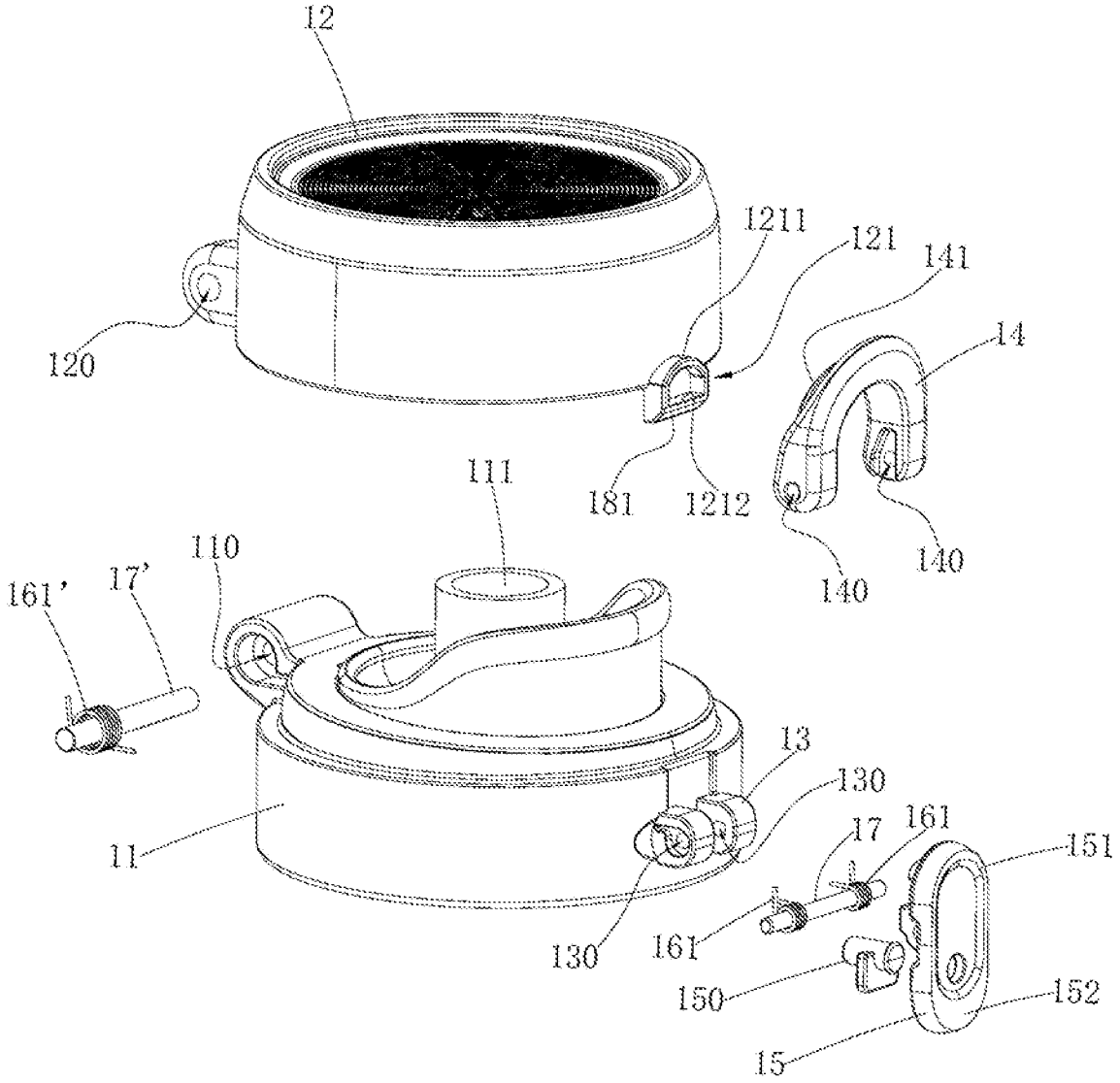
FIG. 3 is an exploded view of the cover shown in FIG. 1.
Figure 4:
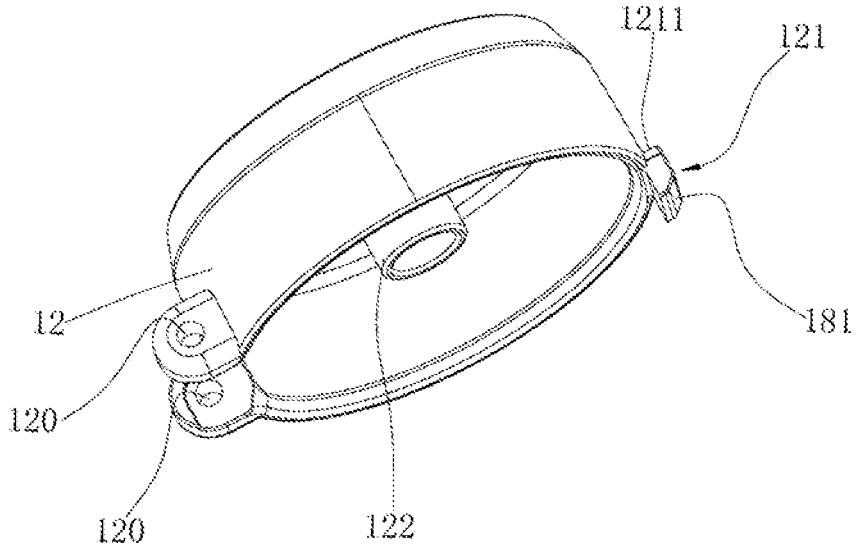
FIG. 4 is a schematic structural diagram of an upper cover.
Figure 5:
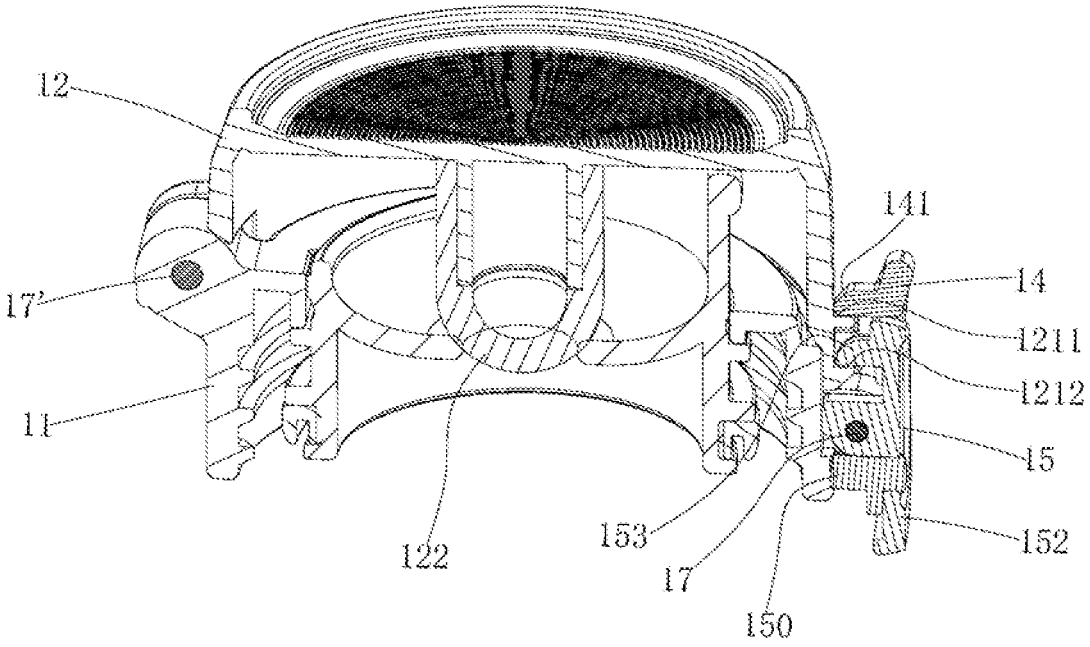
FIG. 5 is a sectional view of the cover shown in FIG. 1.

In order to realize the snap fit between the upper cover and the pressing ring and between the upper cover and the button respectively, as shown in FIGS. 3 to 5, in this embodiment, the first snap portion 121 of the upper cover 12 comprises a first step 1211 and a second step 1212, and the second step 1212 is located below the first step 1211. The first step 1211 here is matched with the snap-fit portion 141 of the pressing ring 14 for a snap fit to achieve the snap fit between the upper cover 12 and the pressing ring 14. The second step 1212 is snap-fitted with the second snap portion 153 of the button 15 to achieve the snap fit between the upper cover 12 and the button 15.

In the process of closing the upper cover, in order to facilitate the upper cover to be able to achieve a snap fit with the pressing ring and the button respectively, referring to FIGS. 3, 4, 8 and 9, in this embodiment, a first guide surface 181 is arranged at the position where the first snap portion 121 comes into contact with the snap-fit portion 141 of the pressing ring 14, and a second guide surface 181 is arranged at the position where the first snap portion 121 comes into contact with the second snap portion 153 of the button 15. For example, the first guide surface 181 may be formed on the first snap portion 121, or may be formed on the snap-fit portion 141 of the pressing ring 14. Certainly, the second guide surface 181 may be formed on the first snap portion 121, or may be formed on the second snap portion 153 of the button 15. By arranging the first guide surface 181, the upper cover 12 can be snap-fitted with the pressing ring 14 more smoothly.

This embodiment further provides a water container, specifically comprising a water container body 2 and the cover 1, the cover 1 and the water container body 2 being fastened and assembled together in a detachable manner.

Embodiment 2

Figure 11:
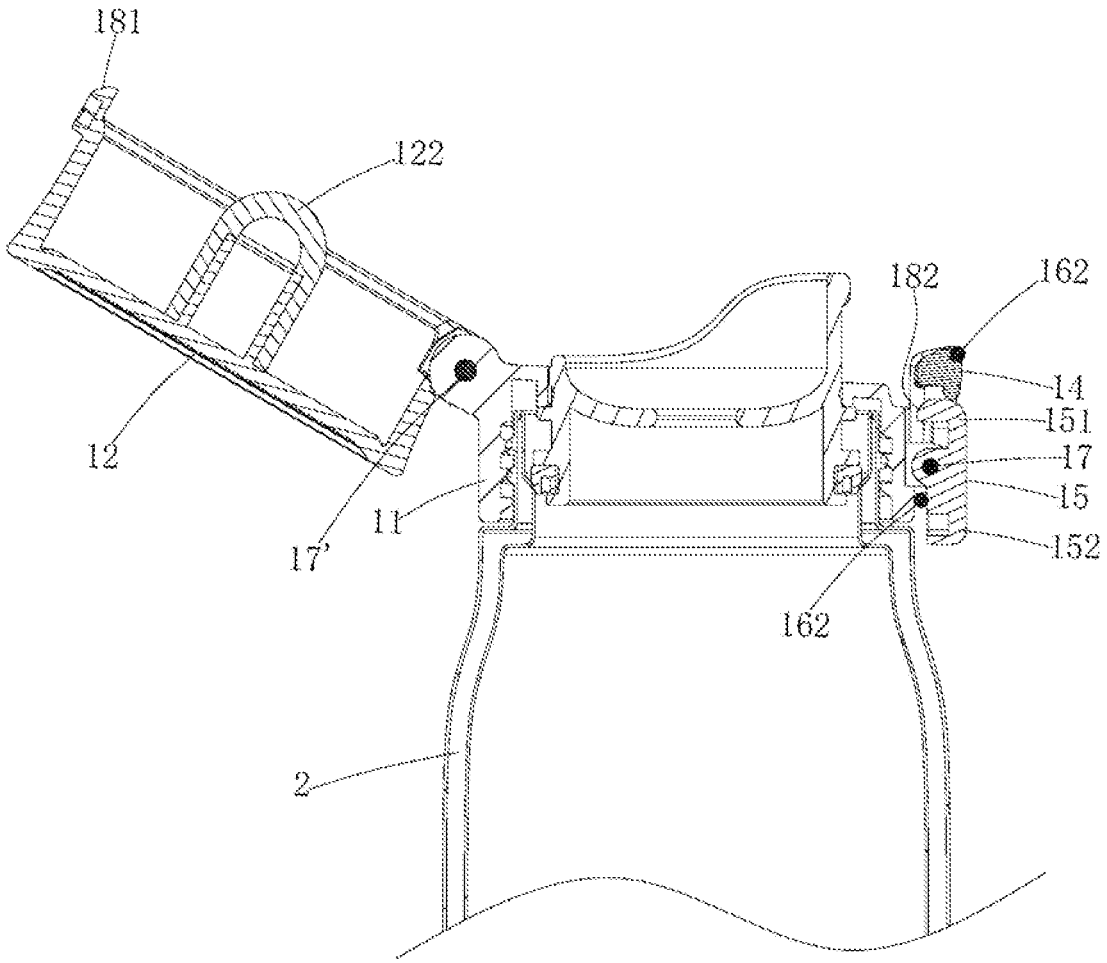
FIG. 11 is a schematic structural diagram of a water container according to Embodiment 2.

Different from the cover in Embodiment 1, as shown in FIG. 11, the reset elastic member in this embodiment is an elastic material component 162, specifically an elastic rubber ring, that is, one end of the elastic material component 162 is connected to the bracket 13 directly or indirectly, and the other end of the elastic material component 162 is connected to the pressing ring 14.

This embodiment also provides a water container, specifically comprising a water container body 2 and the cover 1, the cover 1 and the water container body 2 being fastened and assembled together in a detachable manner.

What is claimed is:

1. A cover comprising:

a cover base;

an upper cover hinged to the cover base, the upper cover having a first snap portion;

a bracket located on the cover base;

a pressing ring hinged to the bracket, the pressing ring having a snap-fit portion for snapping the upper cover; and a button pivotally arranged on the cover base in a lever manner, the button having an upper end and a lower end, the upper end of the button having a second snap portion snap fitted with the first snap portion of the upper cover, wherein the pressing ring is connected to the cover base by a reset elastic member, and when the pressing ring is turned relative to the bracket and pushes against the lower end of the button, a pushing force is applied to the lower end of the button to disengage the second snap portion from the first snap portion.

2. The cover according to claim 1, wherein one end of the reset elastic member is connected to the bracket directly or indirectly, and the other end of the reset elastic member is connected to the pressing ring.

3. The cover according to claim 1, wherein the reset elastic member is configured as a torsion spring.

4. The cover according to claim 3, further including a pivot shaft passing through the bracket, the pivot shaft passing through two opposite sides of the pressing ring, the torsion spring fitted over the pivot shaft.

5. The cover according to claim 1, wherein the reset elastic member is configured as an elastic material component.

6. The cover according to claim 1, wherein the snap-fit portion is located at an upper end of the pressing ring.

7. The cover according to claim 1, wherein the first snap portion includes:

a first step matched with the snap-fit portion of the pressing ring to achieve a snap fit; and a second step, located under the first step and snap-fitted with the second snap portion of the button.

8. The cover according to claim 6, wherein a first guide surface is arranged at a position where the first snap portion of the upper cover is snap fitted with the pressing ring, and/or a second guide surface is arranged at a position where the first snap portion of the upper cover is snap fitted with the button.

9. A water container comprising a container body using the cover according to claim 1.

* * * * *